US006302376B1

(12) United States Patent
Williams

(10) Patent No.: US 6,302,376 B1
(45) Date of Patent: Oct. 16, 2001

(54) SELF-TRANSLATING STAKE PULLER

(76) Inventor: John Williams, 3307 Herbert St., Mogadore, OH (US) 44260

( * ) Notice: Subject to any disclaimer, the term of this patent is extended or adjusted under 35 U.S.C. 154(b) by 0 days.

(21) Appl. No.: 09/285,974

(22) Filed: Apr. 5, 1999

(51) Int. Cl.[7] ..... E21B 19/00
(52) U.S. Cl. ..... 254/30
(58) Field of Search ..... 254/129–132, 254/29 R, 30–31, 120, DIG. 1

(56) References Cited

U.S. PATENT DOCUMENTS

| | | | | |
|---|---|---|---|---|
| 90,559 | * | 5/1869 | Knott | 254/30 |
| 441,864 | * | 12/1890 | Black | 254/30 |
| 762,846 | * | 6/1904 | Rotvold | 254/30 |
| 793,169 | * | 6/1905 | Arnold | 254/30 |
| 1,139,568 | * | 5/1915 | Olson | 254/30 |
| 1,288,223 | * | 12/1918 | Schmitt | 254/30 |
| 1,911,287 | * | 5/1933 | Pladson | 254/30 |
| 2,099,592 | * | 11/1937 | Barton | 254/132 |
| 3,048,368 | * | 8/1962 | Linabery | 254/30 |
| 3,945,611 | * | 3/1976 | Moodie et al. | 254/131 |
| 4,738,433 | * | 4/1988 | Hoff | 254/30 |
| 5,499,795 | * | 3/1996 | Mathews | 254/30 |
| 5,597,151 | | 1/1997 | Duncan . | |

* cited by examiner

*Primary Examiner*—Robert C. Watson
(74) *Attorney, Agent, or Firm*—Kathleen K. Bowen

(57) ABSTRACT

This invention relates to a tool for removing stakes from the ground, or any other medium. More specifically, this invention is directed to a stake puller which freely translates the lateral forces normally exerted by the ground on a stake during removal of the stake at an angle different from that at which it entered the ground. This self-translating stake puller according to the invention comprises a lever arm having opposing first end and second end; a stake engaging mechanism attached to the second end of the lever arm, and configured to pivot the stake about the second end; and, a fulcrum having a top end and a bottom end, wherein the top end is pivotally attached to the lever arm between the first end and the second end, such that the fulcrum plane of pivot is generally parallel to the plane of pivot of the stake about the second end, and wherein the bottom end of the fulcrum is of a size and shape such that the fulcrum can rock easily on the bottom end.

3 Claims, 2 Drawing Sheets

SECTION A-A

DETAIL B

SELF-TRANSLATING STAKE PULLER

BACKGROUND

Stakes are used in many applications. In most applications, they are meant as temporary support, and as such need to be removed. Removing the stakes from the ground can be very difficult, as they are driven in to depths over a foot, and the angle at which they are driven into the ground varies from stake to stake. When a stake is pulled out at an angle different from that at which it entered the ground, the remover must overcome the frictional forces of the ground around the stake on the stake surface, and also the lateral forces of the ground as the stake is pulled against it.

There are devices labeled as stake pullers that use the lever arm/fulcrum combination to increase the mechanical advantage and pull out a stake. A recently patented one being the device disclosed in U.S. Pat. No. 5,597,151 to Duncan entitled Stake Puller with Stake Supporting Backplate. This device uses a lever and fulcrum for mechanical advantage, and adds a backplate to the stake-engaging mechanism to try and minimize the bending shear on the stake. This design lists as it's advantages that it can be used for wooden stakes because of the minimized bending shear, and that it may be "pumped", or reapplied without having to reposition the stake puller between each effort. The problem of bending shear on a stake is only really applicable for a wooden stake; it is not a problem for steel stakes which are becoming the standard. The self touted stability of the fulcrum foot in this disclosure leaves the problem that the stake puller must overcome both the frictional forces of the ground around the stake on the stake surface, and also the lateral forces of the ground as the stake is pulled against it, because pivoting about a stationary fulcrum translates the downward force of the user on the lever arm into a bending force on the stake. The Duncan patent discloses one way to overcome this deficiency, which is to have the user both push down, and pull backward to force the fulcrum to rock on its otherwise stable foot in order to manually compensate for the lateral force exerted by the stake. This makes the stake puller difficult to manipulate, and requires more force by the user.

Even with a stake puller, removing a stake can be quite strenuous. A need exists for a stake puller which is easy to manipulate, and which requires a lesser total force by the user. Such a stake puller would pull a stake out at the angle at which it entered the ground with a simple downward force by the user, to make removal easy and non-strenuous. Such a stake puller would also be effective for removing stakes driven deeply into the ground. There is also a need for a stake puller with a simple stake-engaging mechanism.

SUMMARY OF THE INVENTION

According to an aspect of the invention, a self-translating stake puller for removing a stake, comprising a lever arm having opposing first end and second end, a stake-engaging mechanism attached to the second end of the lever arm, and configured to pivot the stake about the second end, and a fulcrum having a is top end and a bottom end, wherein the top end is pivotally attached to the lever arm between the first end and the second end, such that the fulcrum plane of pivot is generally parallel to the plane of pivot of the stake about the second end, and wherein the bottom end of the fulcrum is of a size and shape such that the fulcrum can rock easily on the bottom end. According to another aspect of the invention, there is a method for removing stakes from the ground by using the stake puller described above.

DETAILED DESCRIPTION OF THE DRAWINGS

Figure 1:
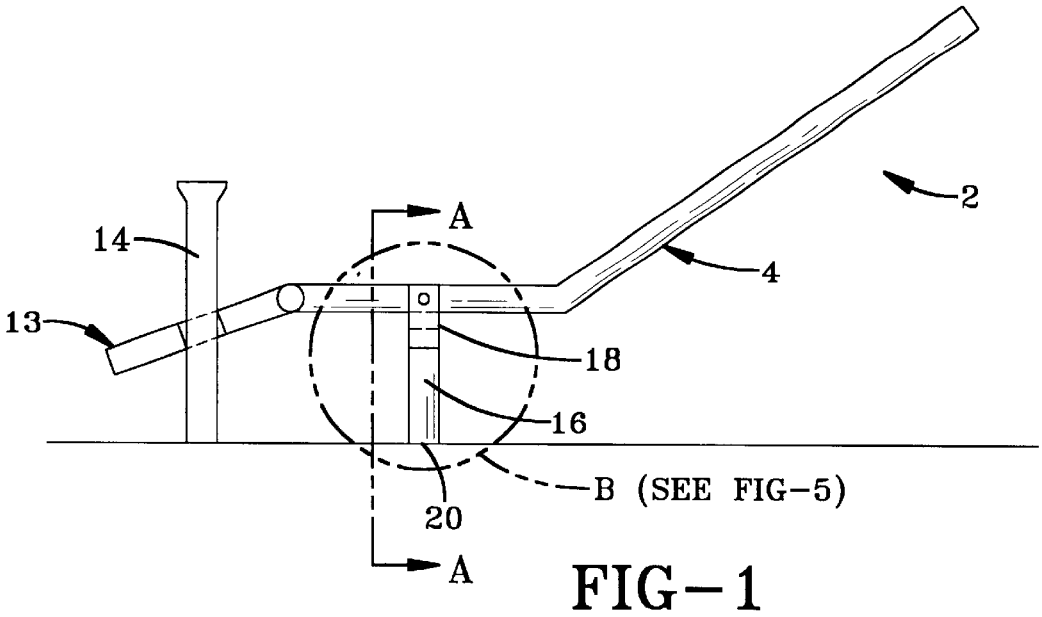
FIG. 1 presents a side view of a self-translating stake puller engaged with a stake.
Figure 2:
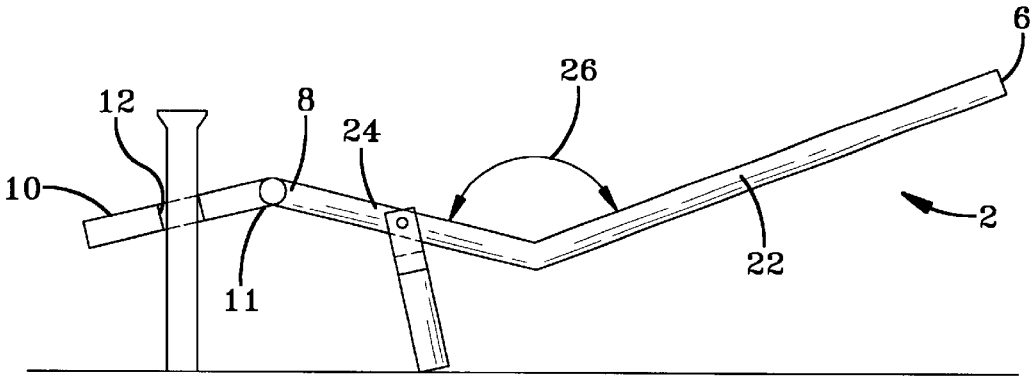
FIG. 2 presents a side view of the stake puller of FIG. 1, in use.

Various aspects of the invention are presented in FIGS. 1–5 which are not drawn to scale, and in wherein like components are numbered alike. The stake puller which is the subject of this invention, is self-translating because it translates the downward force of the user into an upward force on the stake with no further manipulation by the user. This is accomplished by configuring the fulcrum such that the lateral force exerted by the ground on the stake, and subsequently by the stake on the stake puller, easily pivots the fulcrum in relation to the ground. Thus, virtually none of the downward force of the user is wasted in bending force on the stake, and the self-translating stake puller extracts the stake at the angle of least resistance, which is the angle at which it entered the ground. Referring now to FIGS. 1 and 2, a side view of a self-translating stake puller 2 engaged with a stake 14 is presented, by way of example that implements various aspects of the invention. The self-translating stake puller 2 comprises a lever arm 4 having opposing first end 6 and second end 8, a stake-engaging mechanism 13 is attached to the second end 8 of the lever arm 4, and configured to pivot the stake 14 about the second end 8, and a fulcrum 16 having a top end 18 and a bottom end 20, wherein the top end 18 is pivotally attached to the lever arm 4 between the first end 6 and the second end 8, such that the fulcrum 16 plane of pivot is generally parallel to the plane of pivot of the stake 14 about the second end 8, and wherein the bottom end 20 of the fulcrum 16 is of a size and shape such that the fulcrum 16 can rock easily on the bottom end 20. A plane is defined by three points. As the fulcrum pivots, the point of pivot is constant, and a point on the fulcrum when it is in two different positions along with this pivot point define a plane. This is considered the plane of pivot of the fulcrum. Likewise, as the stake is engaged and pulled from the around it pivots about the second end of the lever arm, this pivot point along with a point on the stake when it is in two different positions defines a plane. This is the plane of pivot of the stake. In a further embodiment of the invention, the bottom end 20 is comprised of rubber, or a similar gripping material, to prevent the bottom end 20 from slipping.

Figure 3:
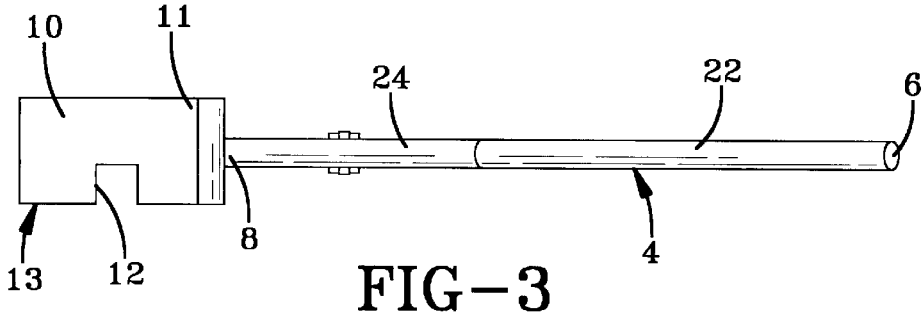
FIG. 3 presents a top view of the stake puller of FIG. 1, NOT engaged with a stake.

There are several stake engaging mechanisms known in the art, one such being that described in the aforementioned Duncan U.S. Pat. No. 5,597,151. Any such mechanism which can engage a stake, allow for it to pivot about the second end 8 of the lever arm 4, and can slide back down the stake when the lever arm 4 is released would suffice. Many stake-engaging mechanisms presently used have disadvantages such as complexity of manufacture, complexity of use, or even limitations on use, such as if the stake head were pounded enough that the head on the stake was widened to the point that a stake-engaging mechanism could no longer slide over the top. Referring now to FIG. 3, in a preferred embodiment of the invention, the stake-engaging mechanism 13 comprises a plate 10 pivotally attached along one edge 11 to the second end 8 of said lever arm 4 wherein the plate 10 has a notch 12 which is generally perpendicular to the plane of pivot of the plate 10, and wherein the notch 12 is deeper than the stake 14 diameter, and wherein the notch 12 is slightly wider than the stake 14 diameter. This stake-engaging mechanism overcomes the disadvantages mentioned regarding the prior art stake-engaging mechanisms.

According to another aspect of the invention, the lever arm 4 is bent in the plane of pivot of the fulcrum 16 forming two portions, portion one 22 and portion two 24, wherein the first end 6 is on portion one 22 which serves as a handle, and the second end 8 is on portion two 24, wherein portion one 22 is longer than portion two 24, and wherein the fulcrum 16 is pivotally attached to portion two 24, wherein portion one 22 makes an obtuse angle 26 with portion two 24, and the fulcrum 16 is not within the obtuse angle 26.

Figure 5:
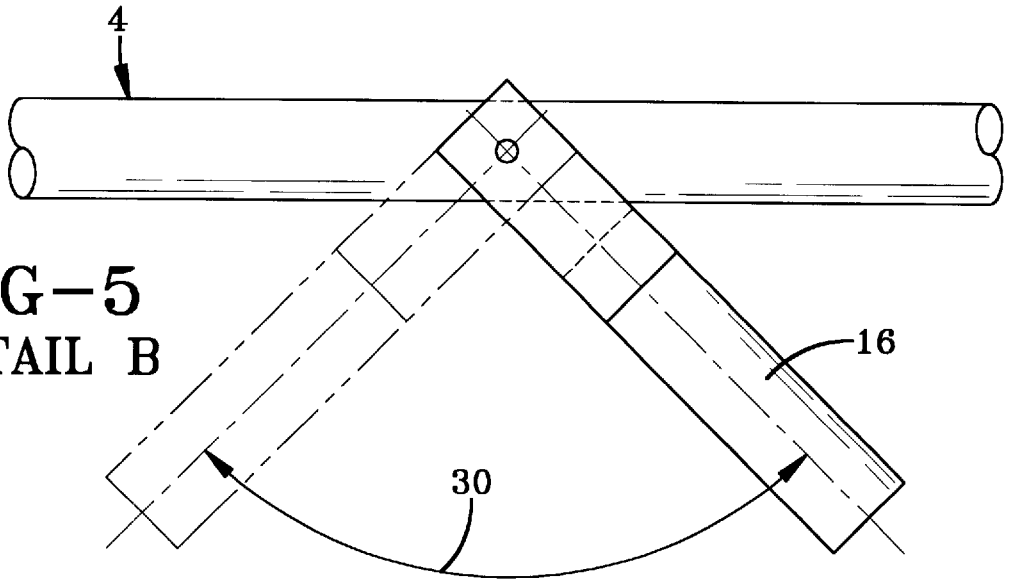
FIG. 5 presents Detail B from FIG. 1, a close up of the fulcrum function.

FIG. 5 focuses in on another aspect of the invention, the range of motion of the fulcrum. As previously mentioned, the bottom end 20 of the fulcrum 16 may be comprised of rubber or a similar gripping material, to prevent slipping, however, in the following aspect of the invention, even if slipping does occur, the mechanism will not collapse due to the limited range of motion 30 of the fulcrum 16. According to an aspect of the invention the fulcrum 16 is pivotally attached to the lever arm 4 such that the fulcrum 16 has a range of motion 30 less than 90° but more than 20°, wherein when the fulcrum 16 is in the middle of the range of motion 30. the fulcrum 16 is generally perpendicular to the lever arm 4. In a further aspect of the invention, the fulcrum 16 is pivotally attached to the lever such that the fulcrum 16 has a range of motion 30 less than 45° but more than 20°, wherein when the fulcrum 16 is in the middle of the range of motion 30, the fulcrum 16 is generally perpendicular to the lever arm 4.

According to a further aspect of the invention, a method is provided for pulling stakes out of the ground, or any similar medium. Referring again to FIGS. 1–3, the method begins with the step of securing the stake 14 within a stake-engaging mechanism 13 which is attached to a second end 8 of a lever arm 4 having a first end 6 and a second end 8, wherein the stake-engaging mechanism 13 is configured to pivot the stake 14 about the second end 8, Once the stake-engaging mechanism 13 is secured around the stake 14, the next step is applying a downward force to the first end 6 of the lever arm 4 which is pivotally supported by a fulcrum 16 with a top end 18 and a bottom end 20, such that the plane of pivot of the fulcrum 16 is generally parallel to the plane of pivot of the stake 14 about the second end 8 and wherein the bottom end 20 of the fulcrum 16 is of a size and shape such that the fulcrum 16 can rock easily on the bottom end 20. Continue downward force on the lever arm 4 as the stake 14 exerts horizontal force on the lever arm 4; the horizontal force is freely translated along the lever arm 4, causing the lever arm 4 to move in a horizontal direction by pivoting on the fulcrum 16 which will rock forward on the bottom surface 20. After a relatively short stroke, either due to the comfort of the user, or the limitation on the fulcrum range of motion, the next step is to release the lever arm 4 such that the stake-engaging mechanism 13 will slide down the stake 14. Reapplying downward force on the first end 6 of said lever arm 4, and repeating these steps (essentially "pumping" the handle of the stake puller) will result in removing the stake 14 from the ground sufficiently to allow the stake 14 to be easily pulled out by hand. In a preferred embodiment of the invention, the stake engaging mechanism 13 used in this method comprises a notch 12 which is deeper than the stake 14 diameter, and which is slightly wider than the stake 14 diameter, within a notched plate 10 which is pivotally attached to the second end 8 of the lever arm 4, wherein the notch 12 is generally perpendicular to the plane of pivot of the notched plate 10.

Figure 4:
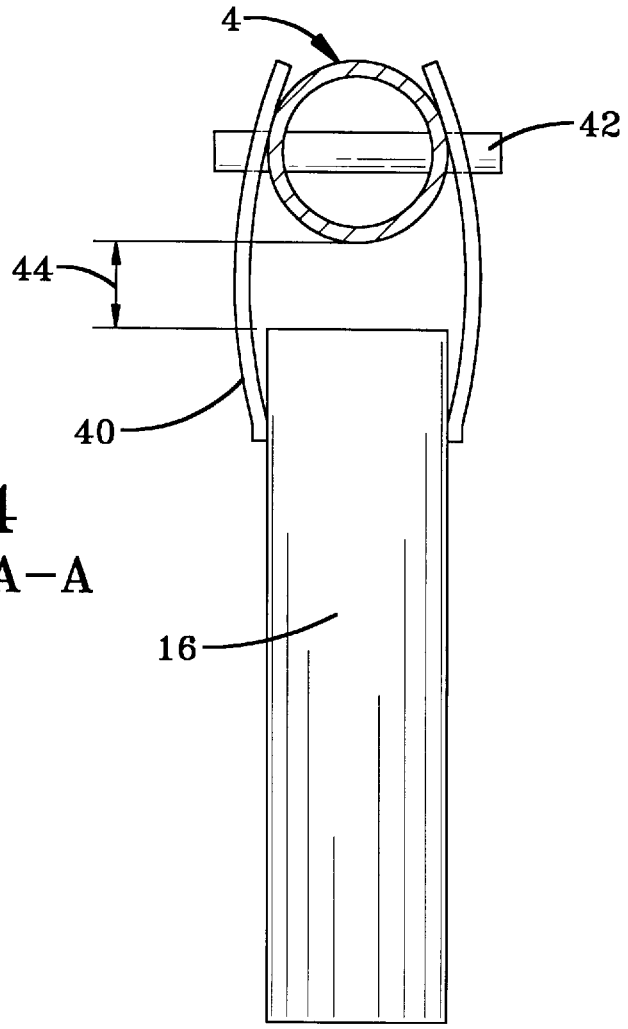
FIG. 4 presents View A—A from FIG. 1, an end view of the lever arm.

Referring now to FIG. 4, according to a certain preferred embodiment, the lever arm 4 is constructed out of steel pipe, as is the fulcrum 16. The fulcrum 16 is attached to the lever arm 4 by welding flat stock to the fulcrum 16 on both sides, and placing a pin 42 thru the free end of the welded flat stock 40, thru the lever arm 4, such that the fulcrum rotates about the pin. The range of motion 30 of the fulcrum 16 may be limited by the amount of clearance 44 between the pipe used for the fulcrum, and the lever arm 4, the greater the clearance 44, the greater the range of motion 30. In a further preferred embodiment, the clearance 44 is about ½", and the pipe used for both the lever arm 4 and the fulcrum 16 is ¾" steel pipe. The length of the lever arm is approximately 36" overall, with portion one 22 accounting for approximately 32" of that length. The fulcrum in this embodiment is approximately 4" in length. Further, the stake-engaging mechanism 13 is a ½ inch thick steel plate roughly 3.5"×4", with a 1.125" wide by 1.5" deep notch 12. The stake engaging mechanism 13 is hinged to the second end 8 of the lever arm 4.

I claim:

1. A self-translating stake puller for removing a stake, comprising:

a lever arm having opposing first end and second end, a stake-engaging mechanism attached to said second end of said lever arm, and configured to pivot said stake about said second end; and, a fulcrum having a top end and a bottom end, wherein the top end is pivotally attached to the lever arm between the first end and the second end, such that the fulcrum plane of pivot is generally parallel to the plane of pivot of the stake about the second end, and wherein the bottom end of the fulcrum is of a size and shape such that the fulcrum can rock easily on the bottom end; and, wherein said lever arm is bent in the plane of pivot of said fulcrum forming a bend, and forming two portions, portion one and portion two, wherein said first end is on portion one which serves as a handle, and said second end is on portion two; and, wherein portion one is longer than portion two, and wherein said fulcrum is pivotally attached to portion two between the bend and said second end, wherein said portion one makes an obtuse angle with said portion two, and said fulcrum is not within said obtuse angle.

2. The stake puller of claim 1 wherein said fulcrum is pivotally attached to said lever arm such that said fulcrum has a range of motion less than 90° but more than 20°, wherein when said fulcrum is in the middle of said range of motion said fulcrum is generally perpendicular to said lever arm.

3. The stake puller of claim 1 wherein said fulcrum is pivotally attached to said lever arm such that said fulcrum has a range of motion less than 45° but more than 20°, wherein when said fulcrum is in the middle of said range of motion said fulcrum is generally perpendicular to said lever arm.

* * * * *